US006364928B1

(12) United States Patent
Larsson et al.

(10) Patent No.: US 6,364,928 B1
(45) Date of Patent: Apr. 2, 2002

(54) PROCESS AND PLANT FOR PRODUCING ATOMIZED METAL POWDER, METAL POWDER AND THE USE OF THE METAL POWDER

(75) Inventors: Rutger Larsson; Erik Axmin, both of Klippan (SE)

(73) Assignee: Rutger Larsson Konsult AB (SE)

( * ) Notice: Subject to any disclaimer, the term of this patent is extended or adjusted under 35 U.S.C. 154(b) by 0 days.

(21) Appl. No.: 09/698,506

(22) Filed: Oct. 26, 2000

Related U.S. Application Data

(62) Division of application No. 09/171,451, filed as application No. PCT/SE97/00656 on Apr. 18, 1997, now Pat. No. 6,146,439.

(30) Foreign Application Priority Data

Apr. 18, 1996 (SE) ..... 9601482

(51) Int. Cl.[7] ..... B22F 1/00
(52) U.S. Cl. ..... 75/255; 75/355
(58) Field of Search ..... 75/255, 355

(56) References Cited

U.S. PATENT DOCUMENTS

| | | | | |
|---|---|---|---|---|
| 4,025,249 A | | 5/1977 | King | 425/6 |
| 4,124,377 A | | 11/1978 | Larson | 75/0.5 |
| 4,224,260 A | * | 9/1980 | Dain et al. | |
| 4,385,929 A | * | 5/1983 | Ichidate et al. | |
| 4,437,883 A | * | 3/1984 | Kubo et al. | |
| 4,437,891 A | * | 3/1984 | Umino et al. | 75/251 |
| 4,810,284 A | * | 3/1989 | Auran et al. | |
| 5,749,938 A | * | 5/1998 | Coombs | 75/332 |

FOREIGN PATENT DOCUMENTS

| | | | |
|---|---|---|---|
| EP | 0108175 | * | 5/1984 |
| EP | 0221869 | * | 5/1987 |
| EP | 0221869 | | 5/1997 |
| GB | 2209536 | * | 5/1989 |
| SE | 207714 | | 9/1966 |
| SE | 444513 | * | 4/1986 |
| SE | 448835 | * | 3/1987 |
| SE | 451551 | * | 10/1987 |
| SE | 207714 | * | 4/1996 |

* cited by examiner

*Primary Examiner*—Ngoclan Mai
(74) *Attorney, Agent, or Firm*—Ostrolenk, Faber, Gerb & Soffen, LLP

(57) ABSTRACT

The present invention relates to a process for manufacturing atomized metal powder in an atomization plant comprising a casting box, a reactor vessel, a powder container and sedimentation equipment. The production process takes place with controlled thermal balance. The invention also relates to an atomization plant, atomized metal powder and the use of the metal powder as coolant in the manufacture of steel.

8 Claims, 2 Drawing Sheets

PROCESS AND PLANT FOR PRODUCING ATOMIZED METAL POWDER, METAL POWDER AND THE USE OF THE METAL POWDER

This is a division of application Ser. No. 09/171,451, filed Oct. 16, 2000 U.S. Pat. No. 6,146,439 which is a 371 of PCT/SE97/00656 filed Apr. 18, 1997.

The present invention relates to a process for producing atomized metal powder in an atomization plant comprising a casting box, a reactor vessel, a powder container and sedimentation equipment. The invention also relates to the atomization plant, atomized metal powder produced according to the process and the use of the metal powder.

One of the problems in manufacturing atomized metal powder is that the thermal balance in the reactor is not in balance and that critical temperatures occur. This entails increased risk of explosion since the firing temperature and partial pressure are reached in uncontrolled manner.

Another problem is that if the pressure of the spray coolant is too high the powder particles will be deformed, becoming uneven and pointed in shape. High temperature of the spray coolant also causes the formation of waves on the surface of the liquid.

The object of the present invention is to provide a solution to these problems. According to the invention they are solved by introducing atomizing medium into the reactor vessel via primary nozzles in the upper part of the reactor. Coolant is then supplied at low pressure via at least one secondary supply arrangement in the upper part of the reactor vessel, arranged in combination with the nozzles for atomizing medium. Coolant and atomizing medium are withdrawn from the lower part of the reactor and then recirculated via a number of transport arrangements and sedimentation equipment. Some of the metal powder is removed directly from the reactor, down into a powder container. The rest of the metal powder is separated through sedimentation in sedimentation equipment.

The embodiment described above, and other embodiments of the invention, are defined in the dependent claims.

DESCRIPTION OF THE INVENTION

From a casting box a stream of molten metal, preferably steel, flows into the reactor vessel. The stream is disintegrated by atomizing medium flowing under high pressure from primary nozzles in the upper part of the reactor. Secondary coolant is allowed to flow under low pressure from at least one annular extruder in connection with the primary nozzles. The coolant flows down through the gas chamber of the reactor vessel and forms cooling curtains. The gas-filled part of the reactor is therefore smaller than the corresponding gas chamber in conventional atomizing plants. Large quantities of coolant at low pressure achieve efficient cooling of the powder particles without them become deformed. They retain their spherical shape since the thrust with which the coolant encounters the particle surface is limited. The desired final product is thus obtained and at the same time the thermal balance necessary for safety of the process is also achieved. Wave formation is greatly suppressed through the supply of secondary coolant through the annular extruders and the variation in the path of the powder particles from vortex to liquid surface is thus reduced.

In order to attain constant conditions in the reactor vessels the coolant balance must be at equilibrium during the atomizing period. The same amount of coolant must be removed from the reactor vessel as is supplied during the same time period. The falling rate of metal powder with a size of 100$\mu$ is in the order of magnitude a few cm/sec. So that the reactor plant does not become unreasonably large the bottom of the reactor vessel has been provided with an inner cone so that the powder formed is guided down through the bottom outlet and into a powder container, known as a wet container. The coolant is sucked out via a specially shaped suction chamber arranged in the lower part of the reactor vessel. Only marginal quantities of powder particles larger than 100$\mu$ are drawn out through this suction chamber. Particles smaller than 100$\mu$, preferably smaller than 50$\mu$, are carried out with the coolant. Powder of such small particle size is very attractive for certain purposes and it is therefore important that this fraction can be salvaged in a simple and efficient manner without extra work operations. This can easily be achieved by allowing the coolant withdrawn to sediment in at least two cylindrical sedimentation containers having conical bottoms. The inclination of the cones shall at least exceed the angle of repose of the powder.

The sedimentation container is dimensioned with a good margin to hold the coolant and atomizing medium required for one charge of powder in the atomizing process. The height and diameter of the container must be optimized to allow all powder particles larger than 20$\mu$ to have time to settle between two charges. The inlet for coolant and atomizing medium into the container shall also be designed and placed to facilitate sedimentation. From the above, therefore, it is evident that at least two sedimentation containers are necessary for the atomizing process. The coolant withdrawn passes a suction pump. Since the sedimentation container holds the coolant and atomizing medium requirement for a full charge, atomization and subsequent cooling of the powder occurs down to solidification temperature with exactly the same cooling and atomizing medium temperature throughout the charge. This results in a powder with optimal reproducibility with regard to atomizing, particle shape and distribution of carbon in the powder produced.

The coolant is introduced into a storage tank having an inlet part in the form of a sedimentation basin. The sedimented powder particles, the majority of which are smaller than 100$\mu$, are collected in a separate wet container. The coolant freed from powder is recirculated to the reactor vessel via a heat exchanger and with the aid of high-pressure pumps through the spray nozzles as atomizing medium and through the annular extruders as secondary coolant, respectively.

The part-functions described above cooperate to produce an efficiently operating atomization plant with great flexibility with regard to the properties and shape of the powder produced.

A small quantity of the atomizing medium, which preferably consists of acyclic and/or isocyclic hydrocarbon compounds such as paraffin or diesel oils, is carbonized to carbon and hydrogen in the atomizing process. This carbon is completely absorbed by the powder particles, primarily in their outer layer. This causes the metal particles to have increased content of carbide-bound carbon in the outer layer. The hydrogen formed at carbonization increases the pressure in the gas part of the reactor and must therefore be removed. This is achieved via a liquid lock.

DETAILED DESCRIPTION OF THE INVENTION

The invention will be described in more detail with reference to the accompanying drawings.

Figure 1:
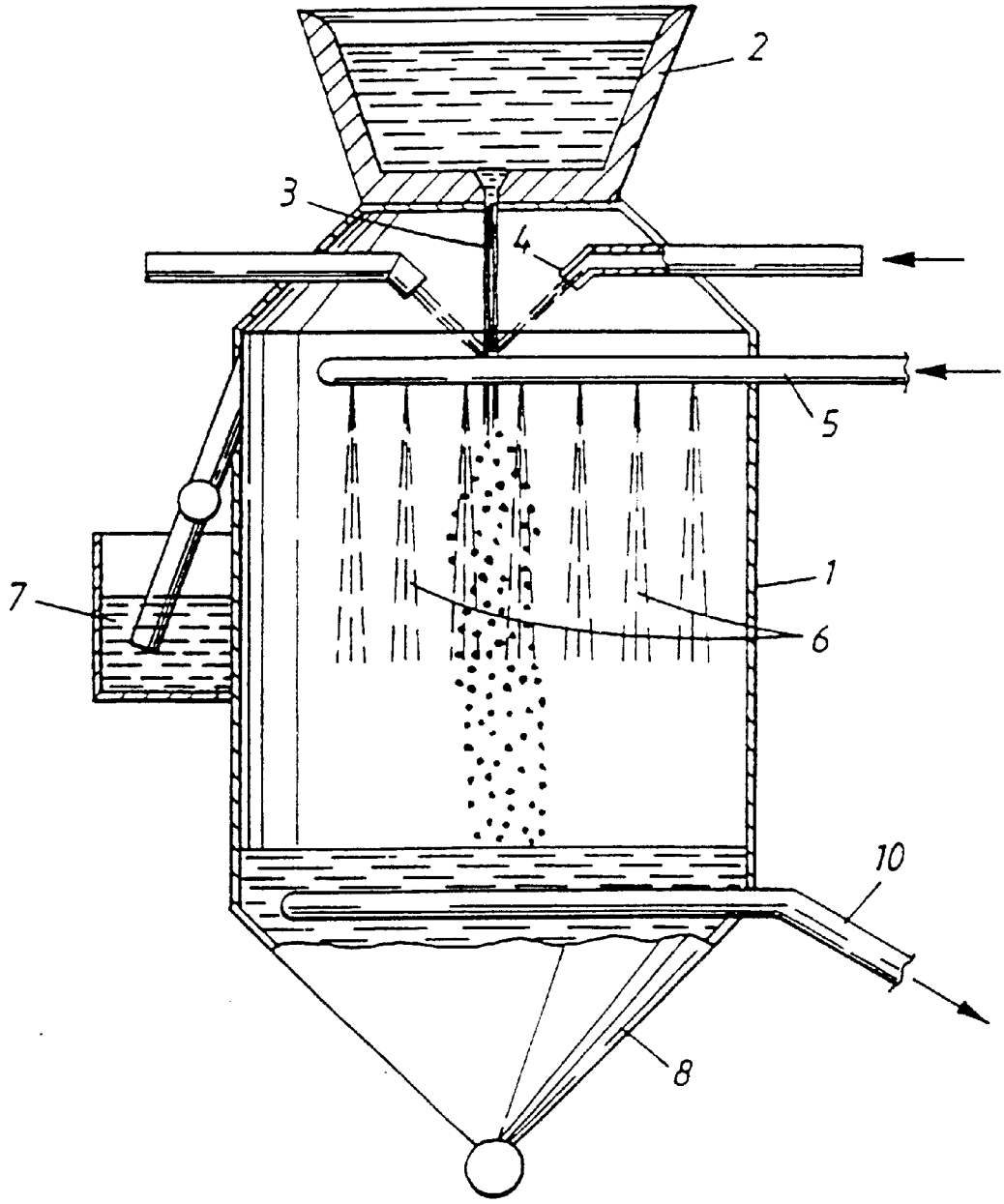
FIG. 1 shows a reactor vessel according to the invention.

The atomizing part of the atomization plant comprises, besides the reactor vessel 1, a casting box 2 for metal melt to be atomized. A metal stream 3 leaves the casting box 2 and at least one nozzle 4 is directed towards this stream. Atomizing medium leaves the nozzle 4 under sufficiently high pressure for the metal stream 3 to be atomized. Large quantities of secondary coolant leave supply arrangements 5 which may be annular extruders, at low pressure. A curtain 6 of coolant is formed which cools the metal powder and causes it to solidify into preferably spherical particles. A liquid lock 7 is arranged in the reactor wall to evacuate the overpressure formed when the atomizing medium is carbonized. The bottom 8 of the reactor vessel is conical so that powder particles larger than 100$\mu$ will be deposited and carried out to a powder container 9, not shown in FIG. 1. To prevent disturbance of the liquid balance, coolant is withdrawn through suction means 10.

Figure 2:
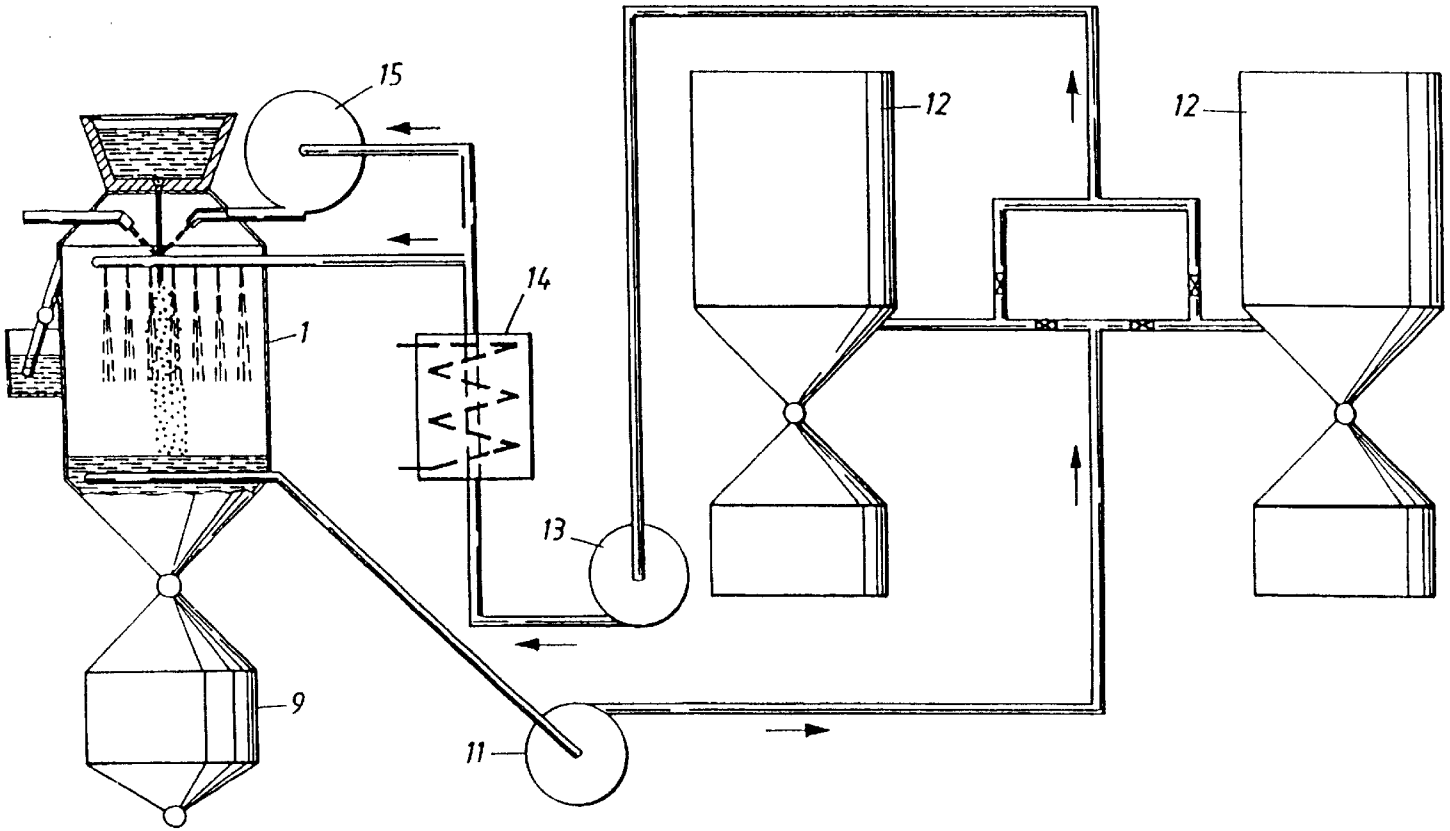
FIG. 2 shows an atomization plant in which the coolant is recirculated in accordance with the invention.

Finer powder particles, the majority of which are smaller than 100$\mu$, accompany the coolant out of the reactor vessel. Fine powder and coolant are pumped by a low-pressure pump 11, see FIG. 2. Coolant containing fine powder is carried to a sedimentation container 12 which is large enough to hold coolant and atomizing medium for a whole charge.

A low-pressure pump 13 pumps coolant and atomizing medium, freed from particles by means of sedimentation, back to the reactor vessel 1 via a heat exchanger 14. A small quantity of the medium is pumped out via the atomizing nozzles 4 by a high-pressure pump 15, in jets directed towards the metal stream 3, thus atomizing said metal stream. Most of the medium is supplied under low pressure through the annular extruders 5, and cools the metal powder formed.

The metal powder formed is spherical in shape and preferably consists of steel. The surface layer of the powder particles has increased carbide-bound carbon as a result of the present atomizing process. When the powder contains steel, the surface layer has an increased content of carbon-bound carbon and low oxygen content. The size and distribution of the particles is >150$\mu$, 150–20$\mu$, and <20$\mu$, preferably >100$\mu$, 100–20$\mu$, and <20$\mu$. The powder particles, also known as IPS powder, are extremely hard because of the high proportion of carbide-bound carbon in the surface layer. The hardness of the IPS powder is approximately 900 as compared with metal powder from conventional atomizing processes where the hardness is approximately 200. Thanks to its hardness, high carbon content and low oxygen content, the IPS powder can be used with tool-polishing effect. The IPS powder with a particle diameter of less than 100$\mu$ can therefore be used for pressure die casting up to a content of approximately 10%.

What is claimed is:

1. An atomized metal powder comprising metal powder particles with an outer layer having increased content of carbide-bound carbon which is obtained by enrichment of the carbon obtained from carbonization of the atomizing medium used in atomizing the metal powder, wherein the atomizing medium used in producing the metal powder is at least one of acyclic and isocyclic hydrocarbon, wherein the powder particles are spherical in shape.

2. The atomized metal powder as claimed in claim 1, wherein the atomizing medium is paraffin or diesel oil.

3. The atomized metal powder as claimed in claim 1, wherein the size distribution of the spherical particles is >100$\mu$, 100–20$\mu$ and <20$\mu$.

4. The atomized metal powder as claimed in claim 1, wherein the metal powder contains steel with an increased content of carbon-bound carbon and low oxygen content in its surface layer.

5. The atomized metal powder as claimed in claim 1, wherein the size distribution of the particles is >150$\mu$, 150–20$\mu$ and <20$\mu$.

6. The atomized metal powder as claimed in claim 4, wherein the size distribution of the particles is >150$\mu$, 150–20$\mu$ and <20$\mu$.

7. The atomized metal powder as claimed in claim 4, wherein the size distribution of the particles is >100$\mu$, 100–20$\mu$ and <20$\mu$.

8. The atomized metal powder as claimed in claim 1, produced in a process comprising atomizing metal powder through introduction of an atomizing medium through a primary nozzle into a reactor vessel with the metal powder to be atomized, and carbonizing to carbon and hydrogen a part of the atomizing medium in a gas part of the reactor vessel;

thereafter supplying coolant at low pressure via at least one secondary supply to the reactor vessel in the upper part of the reactor vessel such that the coolant flows down through a gas chamber of the reactor vessel, and carrying down powder particles formed at atomization into a powder container toward the bottom of the reactor vessel; carrying out the coolant together with finer powder particles by suction applied in the lower part of the reactor vessel and pumping the coolant and the particles for separation by sedimentation of the powder particles.

* * * * *